US005481975A

United States Patent [19]

Schulz

[11] Patent Number: 5,481,975

[45] Date of Patent: Jan. 9, 1996

[54] PRINTING CYLINDER MANDREL AND IMAGE CARRIER SLEEVE

[76] Inventor: Werner Schulz, 44 Hundred Acres Rd., Newtown, Conn. 06470

[21] Appl. No.: 317,635

[22] Filed: Oct. 3, 1994

[51] Int. Cl.[6] ..... B41F 12/10

[52] U.S. Cl. ..... 101/375; 492/4; 492/58

[58] Field of Search ..... 101/375, 376, 101/377, 382.1, 389.1; 242/72 B; 492/4, 5, 58

[56] References Cited

U.S. PATENT DOCUMENTS

| | | | |
|---|---|---|---|
| 3,146,709 | 9/1964 | Bass et al. | 101/375 |
| 3,166,013 | 2/1965 | Wyllie et al. | 492/4 |
| 3,253,323 | 5/1966 | Saueressig | 492/4 |
| 3,378,902 | 4/1968 | Hoexter | 492/4 |
| 3,782,234 | 1/1974 | Rodach | 83/665 |
| 4,030,415 | 6/1977 | Fellows | 492/4 |
| 4,144,813 | 3/1979 | Julian | 101/375 |
| 4,150,622 | 4/1979 | Stollenwerk et al. | 101/378 |
| 4,217,821 | 8/1980 | Vertegaal et al. | 202/375 |
| 4,272,872 | 6/1981 | Hess et al. | 492/4 |
| 4,365,566 | 6/1983 | Moss | 101/375 |
| 4,381,709 | 5/1983 | Katz | 101/375 |
| 4,455,903 | 6/1984 | Kesten | 83/346 |
| 4,624,184 | 11/1986 | Katz et al. | 492/4 |
| 4,651,643 | 3/1987 | Katz et al. | 101/375 |
| 4,656,942 | 4/1987 | Vertegaal et al. | 101/375 |
| 4,685,393 | 8/1987 | Saueressig | 101/375 |
| 4,794,858 | 1/1989 | Katz | 101/375 |
| 4,812,219 | 3/1989 | Sattrup | 101/375 |
| 4,903,597 | 2/1990 | Hoage et al. | 492/4 |
| 4,913,051 | 4/1990 | Molinatto | 492/5 |
| 5,255,604 | 10/1993 | Dürr | 101/389.1 |
| 5,379,693 | 1/1995 | Hoffman et al. | 101/375 |

*Primary Examiner*—Eugene H. Eickholt
*Attorney, Agent, or Firm*—Lawrence Hager

[57] ABSTRACT

A printing cylinder is disclosed comprising a four-piece mandrel assembly having spaced outer journal sections, a first cylindrical sleeve circumferentially mounted at its ends about a respective journal section, a second cylindrical sleeve having an inner diameter slightly larger than the outer diameter of said first cylindrical sleeve and being circumferentially mounted thereon by means, for example, circumferential welds, to provide a substantially uniform space circumferentially between said first and second sleeve members, said second sleeve member having one or more yield or preferential expansion regions, for example, circumferential grooves and a hydraulic system for applying pressure between said first and second sleeve members to thereby effect outward expansion of said second sleeve member.

Another feature of the invention comprises the interchangeability of image carrier sleeves each having a selected thickness for mating operation with different inking rollers.

7 Claims, 3 Drawing Sheets

PRINTING CYLINDER MANDREL AND IMAGE CARRIER SLEEVE

FIELD OF THE INVENTION

This invention relates to a new and improved printing roller or cylinder and, more particularly, to the type of cylinder having a hydraulically-actuated expandable mandrel to lock image carrier sleeves of selectable dimension or thickness.

BACKGROUND OF THE INVENTION

In certain types of printing, for example, gravure printing, a printing cylinder is utilized for the purpose of carrying the inked image or print for the printing operation. The ink is transferred from a cylindrical surface or cylinder to the paper surface that runs between an aligned juxtapositions impression roller and the printing cylinder. The printing cylinder is used to support a cylindrical sleeve like flexible printing plate, and the printing cylinder is designed to be rotatively mounted in a printing press or machine. Flexographic printing uses similar inks, however, the ink is deposited onto a rubber printing plate or sleeve mounted to a cylinder.

It should be recognized that in the course of various printing jobs or operations, it frequently becomes necessary to replace the image carrier sleeve or cylinder with another. Hitherto, various and relatively expensive methods have been proposed to provide a mandrel structure to enable demountable image cylinders for use in the printing machine.

Not infrequently in printing operations the entire mandrel structure is replaced in order to accommodate various circumference image cylinders. Such mandrel replacement is expensive and time consuming. Thus, a long recognized but heretofore unresolved problem of the prior art was the need to have and replace several mandrel type printing rollers to handle image cylinders having different inner diameters, or use of relatively expensive and complex mandrel adapter mechanisms which require valuable machine-down time to install.

Another problem of the prior art printing equipment which utilizes such mandrel arrangements is the confinement or limitation to the use of image cylinders being substantially of equal longitudinal dimensions as the printing cylinder or mandrel.

PRIOR ART STATEMENT

A common method of changing printing cylinders is through heat treatment processes, wherein the cylinders are shrunk onto the journals at their ends, thereby forming a frictional fit between the rotating journals and printing cylinder carried thereon. In order to remove the cylinder, heat is applied to the journal cylinder interface allowing expansion of the cylinder to permit the cylinder to be removed from the journal.

One method to eliminate the heat treatment process for removing printing rollers from the mandrel is disclosed in U.S. Pat. No. 3,378,902 issued Apr. 23, 1978 to Rolf Hoexter. This method is a relatively complex, expensive and difficult system for forming thin-walled pressure plates to carry a radial pressure outwardly to fix the printing cylinder at its spaced end sections to the mandrel by means of two outer collars.

Another prior art system is described in U.S. Pat. No. 4,381,709 issued May 3, 1983 to Robert Katz, wherein there is shown a three piece mandrel assembly which utilizes a hydraulic system to actuate two end rings to fix in-place a printing cylinder at its longitudinal end sections.

In another prior art U.S. Pat. No. 4,651,643 issued Mar. 24, 1987 to Sidney Katz and Robert Katz, relatively expensive and complex adaptors for expandable mandrels of printing presses is disclosed. The adaptors are formed of annular members which are slidable over each end journal of a multi-piece mandrel and lockable thereto. The adaptors each have an outwardly expandable external periphery for gripping and holding a printing cylinder of a diameter larger than that of the mandrel. Thus, this prior art system describes an expensive, complicated and difficult to install system to attempt to adapt a mandrel to an image sleeve having a larger inner diameter than the diameter of the mandrel.

In yet another system as described in U.S. Pat. No. 4,150,622 issued on Apr. 24, 1979 to Joseph A. Stollenwerk, a system employing air pressure is employed in which compressible rings are adapted to be forced outwardly to hold the outer printing cylinder.

Other prior art references of interest are U.S. Pat. Nos. 4,812,219 issued Mar. 14, 1989 to Jane E. Sattrup; 4,794,858 issued Jan. 3, 1989 to Sidney Katz; 4,685,393 issued Aug. 11, 1987 to Karl Saueressig; 4,656,942 issued Apr. 14, 1987 to Jacobus-Gerardus Vertegaal, et al; 4,455,903 issued Jun. 26, 1984 to Martin Kesten; 4,386,566 issued Jun. 7, 1983 to Lester I. Moss; 4,144,813 issued Mar. 20, 1979 to Anthony P. Julian; 3,782,24 issued Jan. 1, 1974 to Alexander Rodach; 3,146,709 issued Sep. 1, 1964 to W. E. Bass, et al.

In total contrast to the prior art, the present invention provides a relatively inexpensive, easy to use system which substantially solves many of the above noted prior art recognized problems and, in addition, incorporates structural simplicity and advantageous features hetherto not available.

For example, the present invention provides: a mandrel having a single circumferential pressure or hydraulic chamber, which extends substantially over the length of the mandrel; does not require seal gaskets between journal sections and the outer expansion jacket or sleeve; groove or contour means for effecting desired expansion/pressure regions or rings about said outer expansion sleeve to thereby provide a substantially uniform outer jacket expansion over a predetermined portion or virtually the full longitudinal length of the jacket with application of hydraulic pressure, which feature not only provides improved fictional gripping of the image carrier sleeve but enables the use of image carrier sleeves having different longitudinal length.

A further distinguishing feature of the present inventive system is the use of different outer diameter sized image carrier sleeves, with each having substantially the same inner diameter to enable being selectively slid onto the outer expansion jacket of the present inventive mandrel structure.

Some of the distinguishing functional features of the present invention are:

- that a printer will require relatively few mandrel type cylinders;
- the use of a plurality of image carrier sleeves each having substantially the same inner diameter;
- the ability of using various image carrier sleeves having different outer diameters on the same mandrel without installing adjustment collects, etc.;
- that the shipping costs, of the relatively light weight image carrier sleeves, from the engraver to the printer are substantially reduced or constrained;

that the handling and storage difficulties and expenses are curtailed;

that any down-time typical with the prior art to replace image carrier sleeves is substantially reduced;

that the operational down-time required in the prior art to retrofit the presses with different sized mandrels is substantially, if not fully, eliminated by the use of image carrier sleeves having selectively different thickness in accordance with the present invention.

SUMMARY OF THE INVENTION

A printing system similar to a so-called gravure or flexographic process, wherein the improvement comprises:

a mandrel assembly having spaced end journal members, a first cylindrical sleeve circumferentially mounted or secured at each end on a respective end journal member, an outer cylindrical jacket mounted on and having an inner diameter greater than the outer diameter of said first or inner sleeve and being substantially coaxial and of equal length therewith, a pressurized/hydraulic circumferential chamber between said first sleeve and said outer jacket, said outer jacket having structural features or contours or grooves to facilitate or effect a virtually uniform expansion of said outer jacket over a portion thereof with hydraulic pressure being applied within said chamber; and a plurality of image carrier sleeves each having an inner diameter dimensioned for selectively being slidingly mounted on said outer mandrel jacket, with each such image carrier sleeve having a different thickness to accommodate for or enable printing applications requiring different outer diameters of the image carrier sleeve(s).

OBJECTS OF THE INVENTION

An object of the present invention is to provide a new and improved printing system.

Another object of the present invention is to provide a new and improved printing system which facilitates the installation and removal of an image printing cylinder with a mandrel assembly.

Another object of the present invention is to provide an improved printing system whereby a plurality of image printing cylinders having selectively different outer diameters may be utilized at different times without replacing the supporting mandrel assembly.

Another object of the present invention is to provide a new and improved mandrel.

Another object of the present invention is to provide a new and improved mandrel assembly having an outer expandable circumferential jacket.

Another object of the present invention is to provide a new and improved mandrel assembly having an outer expandable circumferential jacket with a longitudinal length substantially or approximately equal to the length of the main cylinder portion of the mandrel.

Another object of the present invention is to provide an outer expandable circumferential jacket having a relatively greater length with respect to mandrel assembly.

Another object of the present invention is to provide a circumferential hydraulic chamber being longitudinally coextensive with the image carrier sleeve.

Another object of the present invention is to provide a mandrel assembly having inner and outer coaxial sleeves with a hydraulic chamber therebetween each being substantially of equal length.

Another object of the present invention is to provide a mandrel assembly having a relatively less expensive, less complex and more reliable hydraulic system.

Another object of the present invention is to provide a mandrel system capable of mounting/accommodating image printing/carrying cylinders having substantially and relatively different longitudinal lengths and/or thickness.

Another object of the present invention is to provide a new and improved mandrel assembly for effecting relatively greater and uniform fictional gripping of the image printing cylinders across its entire inner circumference and length.

Other objects, advantages and structural/functional features of this invention will become more apparent from the following description.

BRIEF DESCRIPTION OF THE DRAWINGS

The invention will now be described with reference to the accompanying drawings, which are illustrative of the preferred embodiments of the invention. Like reference numerals refer to like parts throughout.

DETAILED DESCRIPTION OF THE PREFERRED EMBODIMENTS OF THE INVENTION

Figure 1:
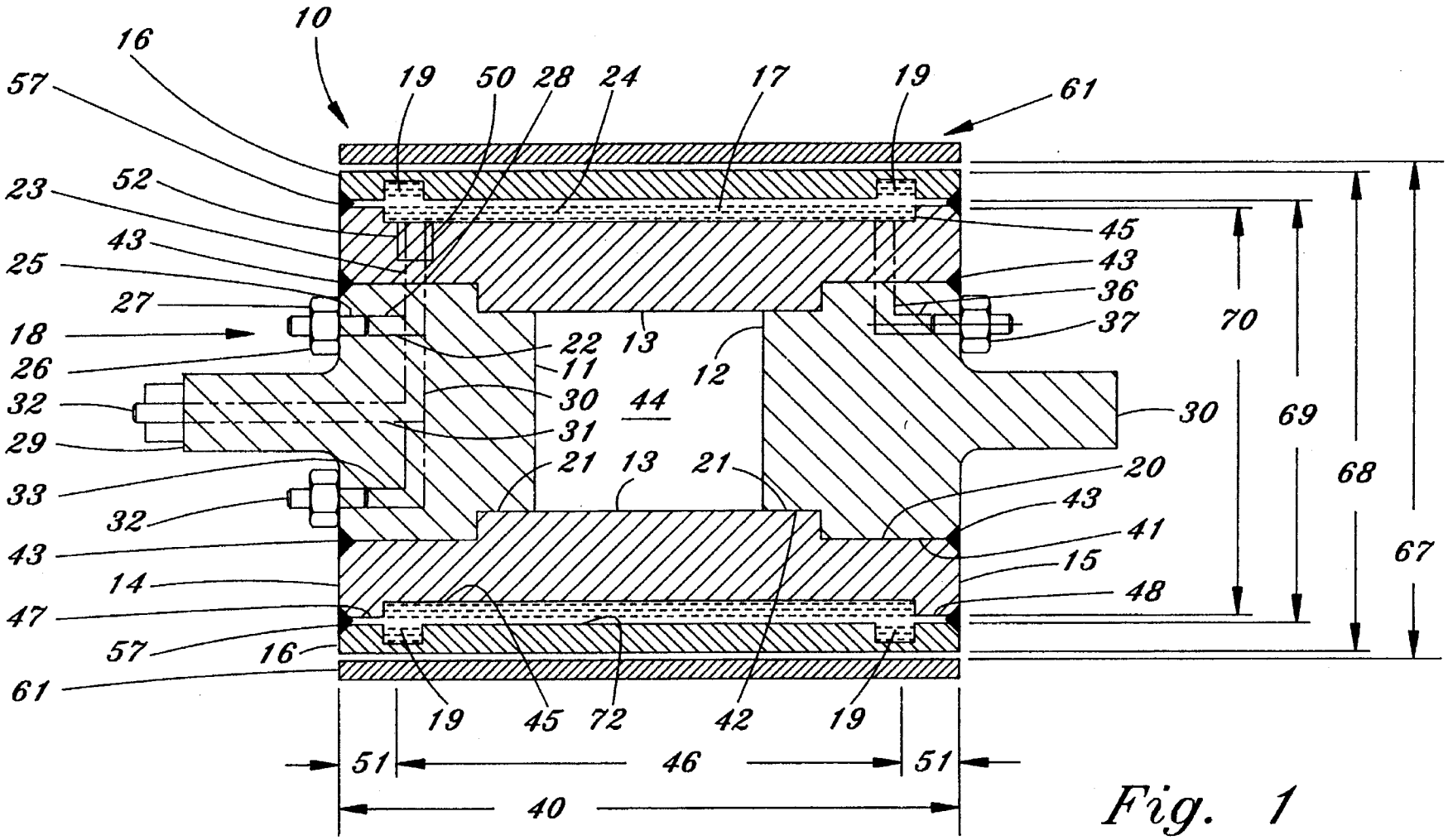
FIG. 1 is a longitudinal sectional view through a printing roller according to one embodiment of this invention.

With reference now to FIG. 1, there is shown an expandable mandrel or printing roller 10 with an image printing sleeve 61 being mounted thereon in accordance with the present invention.

In basic terms, the expandable mandrel 10 generally comprises a pair of spaced end journal members 11, 12, an inner or central sleeve 13 circumferentially mounted at its end regions 14, 15 to a respective end journal 11, 12, an outer expandable sleeve or jacket 16, a pressure chamber 17, a pressure or hydraulic delivery system 18, and one or more expansion grooves or selective expansion means 19.

Each end journal member 11, 12 is formed of suitable material such as steel and has a circular outer configuration 20 of predetermined diameter, and a lower circumferential ledge 21. One or both journal members 11, 12 contain hydraulic fluid passageways 22, 23 for containing hydraulic fluid 24. In accordance with this embodiment of the invention, only one end journal member 11 need contain drill holes or throughbores 22, 23 comprising a portion of the hydraulic system 18. It being noted that an advantage of the present invention is the ability to provide a relatively less complex and less expensive hydraulic throughbores 22, 23 in only one end journal member 11. The mouth end of throughbore 22 contains female threads 25 for matingly receiving the male threads of a hydraulic actuator 26. The hydraulic actuator 26 contains exterior sections such as a hexagonal nut like portion 27 which when manually rotated clockwise and counter-clockwise causes the hydraulic plunger 28 to be selectively displaced inwardly and outwardly.

Each end journal member 11, 12 has an outwardly projecting trunnion 29, 30, respectively, which are used to rotatably mount the mandrel 10 onto the printing press (not shown). Since such trunnion 29, 30 mounting members are conventional, detail discussion thereof will be omitted to avoid prolixity.

Shown in phantom dot dash outline is an alternative drill hole(s) 30, 31 and hydraulic actuator 32 placement. It is noted that although the alternative hydraulic passageways 30, 31 embodiment would require somewhat longer drill holes, such placement may be desired for selected purposes and printing operation/equipment without departing from the teachings of this invention.

Another alternative embodiment shown in phantom dotted outline of the hydraulic fluid passageways includes a release valve 32 and connecting throughbore 33, shown in phantom outline. In usual operation a separate release valve 32 may be superfluous or redundant, since the main adjustment valve 27 may be rotated, for example counter-clockwise, to outwardly displace the plunger and, thereby, reduce or release the hydraulic pressure within the hydraulic system. However, it is contemplated that for selected operations a separate release valve 32 may be desired.

Another alternative embodiment shown in phantom outline 35 is a second hydraulic fluid passageway 36 and adjustment valve 37 provided in the other end journal member 12. In this manner, the press operator can select the most accessible end of the mandrel 10 to effect hydraulic fluid pressure.

Another alternative embodiment of the hydraulic actuator is the use of high pressure grease fittings (not shown) in addition to or in place of the closed plunger system described above in detail.

Thus, a feature of the invention enables hydraulic pressure adjustment from only one end or, alternatively, either or both end journal members 11, 12.

The inner sleeve 13, made of suitable metal, generally defines the longitudinal length 40 of the body portion of mandrel 10. Each end of inner sleeve 13 contains a double ledge arrangement 41, 42 extending circumferentially and dimensioned for matingly engaging the circumferential ledges or platforms 20, 21 provided on each end journal 11, 12, respectively. The inner sleeve 13 is snugly or force fitted onto each end journal member 11, 12, and maybe secured, for example, by weld spots 43, thereto to prevent relative rotation between the constituent mandrel members 11, 12, 13. In this manner, a body portion of mandrel 10 is configured having a central hollow core 44 and a circular elongate exterior. The outer circumferential surface of inner sleeve 13 is provided with an undercut or alcove 45 to a predetermined depth, for example to a depth of 0.010 inch, and extending laterally or longitudinally across a selected predetermined portion 46 of the main body portion 40. In the preferred embodiment of the invention the undercut 45 extends substantially the entire length 40 of the main body portion of mandrel 10, while leaving a raised circumferential outer ring 47, 48 on each end of said inner sleeve 13. Notwithstanding, it is contemplated that alternative embodiments of the invention may utilize varied dimensional undercuts, for example, having a length substantially less than the length of mandrel 10. A throughbore is drilled through inner sleeve 13 in alignment with the throughbore 23 located in end journal member 11. It should be noted that an enlarged throughbore 50 may be drilled into inner sleeve 13 and downwardly a desired depth into end journal member 11 to provide an enlarged interconnected/aligned passageway with passageway 23. A seal type sleeve or gasket like member 52 may be inserted into throughbore 50 to avoid or prevent hydraulic fluid leakage between the juxtapositioned surfaces 20, 41 of the journal member 11 and inner sleeve 13.

The outer expandable jacket 16, generally made of suitable metal, has a selected thickness, and a longitudinal length 40 generally equal to or slightly less than that of inner sleeve 13. Jacket 16 is tubular shaped and has a pair of spaced circumferential inner grooves or expansion channels 19. The inner diameter of jacket 16 is slightly greater than the outer diameter of inner sleeve 13, to enable jacket 16 to be slid onto inner sleeve 13. A circumferential welding 57 is provided on each end of jacket 16, to coaxially attach jacket 16 onto and about inner sleeve 13 and to provide circumferential seals therebetween. In this manner, a circumferential and laterally extending hydraulic expansion or pressure chamber 17 is provided. The inner grooves 19 are dimensioned and located, for example, empirically, in order to effect a generally uniform outward circumferential expansion of jacket 16 with application of hydraulic pressure within chamber 17. An inner groove 19 being approximately a distance 51 of 0.250 inch from each end of jacket 16, and being 0.125 inch wide and 0.025 inch deep has been successfully used to effect a substantially uniform expansion in the full region between the inner grooves, with an expansion jacket 16 having a general thickness 55 of 0.09 to 0.129 inch. It should be recognized that other means, for example, varying the channel depth dimensions or thickness of the central area or metallurgical makeup of the expansion jacket 16, may be utilized to effect a virtually uniform or desired circumferential outward expansion of jacket 16 across a longitudinal expanse substantially co-extensive with the main body of mandrel 10, in accordance with one feature of this invention.

The hydraulic pressure system 18 generally comprises expansion chamber 17, hydraulic passageways 22, 23 and the adjustment plunger 28, to control the hydraulic fluid pressure therewithin.

The image printing sleeve 61 is designed and dimensioned for being slid onto the expansion mandrel 10.

Figure 2B:
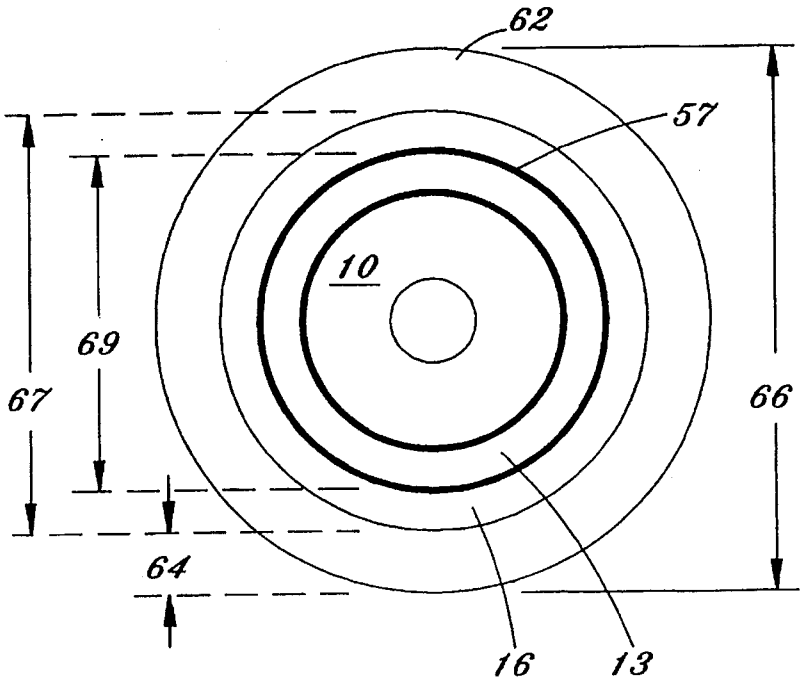
FIG. 2*a* and 2*b* are illustrative plan views of several image carrying sleeves having dimensional variations in accordance with a feature of this invention.
Figure 2A:
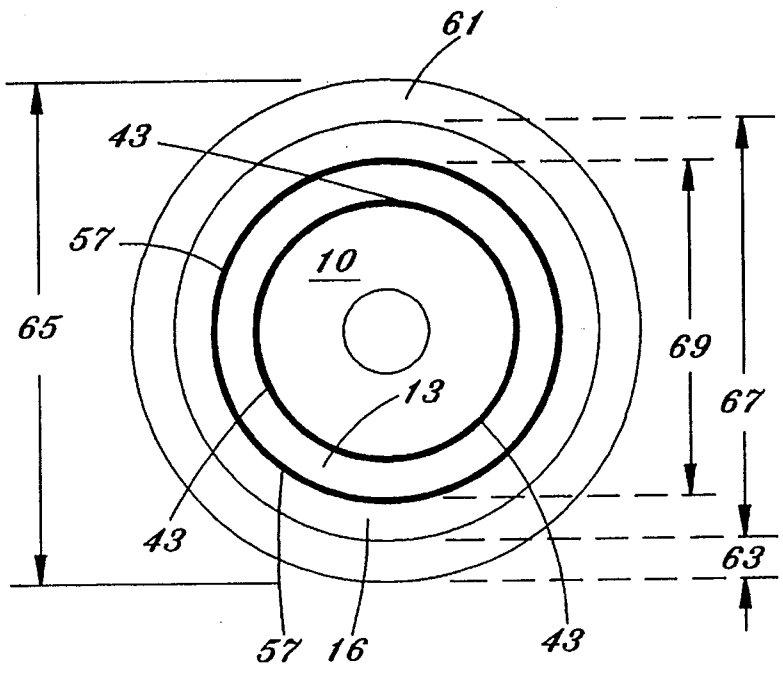

With reference now to FIGS. 2*a* and 2*b*, the use of image printing sleeves 61, 62 having predetermined different thickness's 63, 64 and therefore, selectively varied outer diameters 65, 66, while each having substantially the same inner diameter 67, will now be discussed.

Figure 3B:
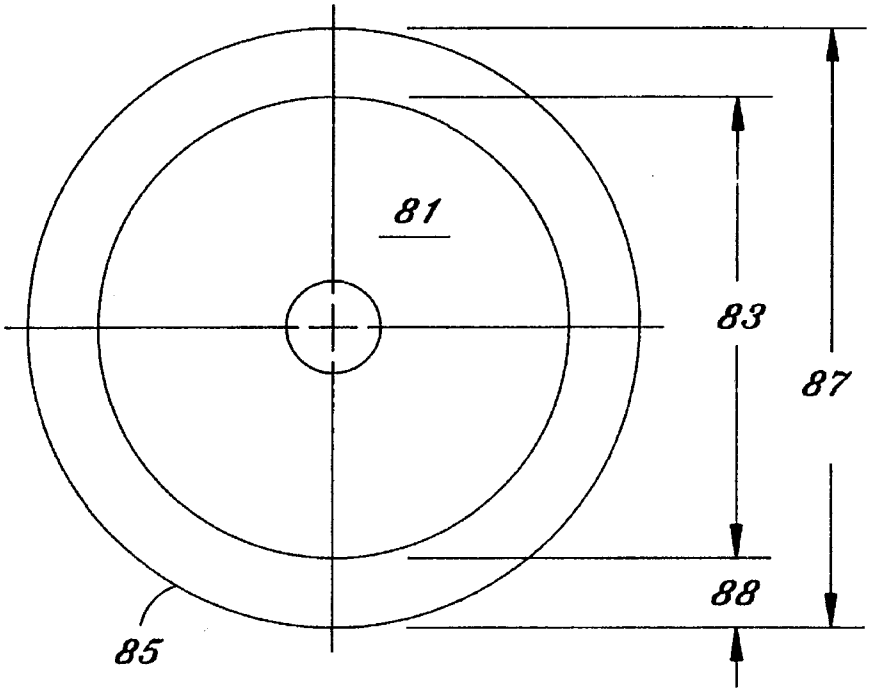
FIG. 3*a* and 3*b* are end views of several prior art mandrel and image printing sleeve arrangements.
Figure 3A:
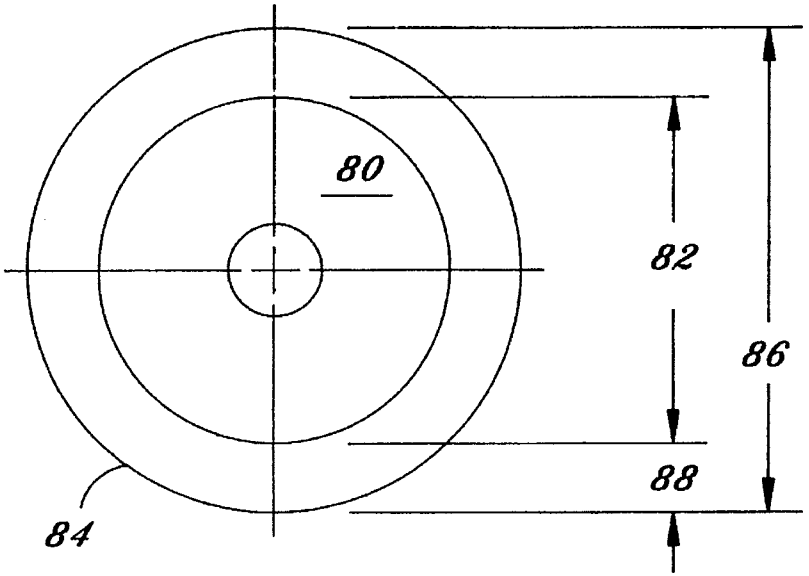

Heretofore, the prior art, see FIGS. 3A and 3B, utilized mandrels 80, 81 having different diameters 82, 83, in order to accommodate image printing cylinders 84, 85 having different inner and outer diameters 82,83,86,87. Thus, in the prior art, image printing cylinders 84,85 had substantially the same thickness 88, and did not vary the cylinder thickness 88 for the purpose of varying the outer diameters 86,87. The prior art utilized different sized mandrels 80,81, which inherently resulted in a relatively costly system of several expensive and difficult to handle/store mandrel 80,81 sizes 82,83.

A feature of the present invention is the use of several image printing sleeves 61, 62 that can be mounted/slid onto a single expansive mandrel 10 having a diameter 68, without necessity of installing different mandrels or relatively expensive mandrel adaptors mounted on each journal member as shown in U.S. Pat. No. 4,651,643.

The system contemplated in accordance with the present invention comprises an expandable mandrel 10 having means or expansion jacket 16 which provides improved fictional gripping over a relatively large axial surface area 46 and the ability of selectively using image printing sleeves 61, 62 having substantially the same inner diameters 67 but with different outer diameters 65, 66. In this manner, print jobs requiring different print area, i.e., length of circumference, on image printing sleeves 61, 62 may be selectively provided without costly replacement or adapting of the mandrel 10.

As will be appreciated, while hydraulic actuator or plunger means have been described, other means of pressurization of chamber 17 can be employed.

While the principles of this invention have been described above in connection with specific embodiments, it is to be understood that this description is merely by way of example and not as a limitation as to the scope of the invention.

What is claimed is:

1. An expandable printing mandrel having particular utility for removably supporting an image printing cylinder, comprising:

a first tubular cylinder (13) having axially-spaced end portions each defining a respective cylindrical opening of predetermined dimension;

a pair of axially-spaced journal members (11, 12) each having an outer cylindrical portion received within a respective one of said cylindrical openings and affixed to the respective tubular end portion;

a second tubular cylinder (16) having an inner diameter (69) greater than the outer diameter (70) of said first tubular cylinder and being mounted thereon and affixed thereto, said second tubular cylinder having two spaced apart groove means (19) for facilitating a relatively uniform circumferentially expandable portion axially extending (46) between said journal members;

actuatable pressure means (18) having a circumferential pressure chamber (17) axially and substantially co-extending with said expandable portion of said second tubular cylinder, said pressure chamber being generally defined between circumferentially spaced wall portions (45) of said first and second tubular cylinders.

2. An expandable printing mandrel as in claim 1, wherein:

the pressure chamber (17) being substantially defined between said alcove and the inner diameter wall portions (72) of said second tubular cylinder.

3. An expandable printing mandrel as in claim 1, wherein:

the second tubular cylinder having two spaced apart circumferential wall portions each being circumferentially welded (57) about a respective end portion of said first tubular cylinder to seal said pressure chamber (17) against hydraulic fluid leakage.

4. An expandable printing mandrel as in claim 1, wherein:

the two axially-spaced grooves (19) each being disposed approximately 0.25 inch from a respective end portion and being approximately 1/16 inch wide and 0.02 in depth.

5. A system for use in a printing press which utilizes a rotatable type mandrel and a removable image printing sleeve, comprising:

a tubular cylinder (13) having axially-spaced circumferential end portions (14,15) each defining a cylindrical opening of predetermined diameter, and having a pair of axially-spaced circumferentially projecting end ridge members (47,48) each generally about a respective one of said end portions and having an outer diameter and having a width (51) approximately 0.25 inch, a circumferential hydraulic pressure chamber (17) being undercut approximately 0.10 inch below the outer diameter of said end ridge members and longitudinally extending (46) a distance defined between said end ridge members;

a pair of axially-spaced journal members (11,12) each cylindrically shaped and dimensioned for being snugly received within a respective one of said cylindrical openings of said tubular cylinder (13) and secured (43) thereto, each said journal member having an outwardly projecting trunnion member (29,30) for rotatable mounting on the printing press, at least one of said journal members having hydraulic fluid passageways (22,23) communicating between a hydraulic pressure adjustment means (28) mounted on said journal member and said hydraulic pressure chamber;

an expansion jacket (16) having a tubular configuration with an inner diameter (69) slightly greater than the outer diameter of said pair of end ridge member (47,48) for being mounted generally about each said end ridge member and circumferentially attachingly sealed (57) thereto to define an upper wall member (72) of said hydraulic pressure chamber (17), said upper wall member (72) having wall portions defining a pair of axially-spaced generally circumferential relief means (19) for effecting a relatively uniform expansion of said expansion jacket between said relief means upon an actuation of hydraulic pressure within said hydraulic pressure chamber;

a plurality of image printing sleeves (61,62) each having a predetermined different thickness (63,64) and outer diameters (65,66) with substantially the same inner diameter (67) for being selectively mountable about said expansion jacket.

6. An expandable printing mandrel having particular utility for removably supporting an image printing cylinder, comprising:

a first tubular cylinder (13) having wall portions defining a circumferential alcove axially extending (46) slightly less than the full axial length (40) of said first tubular cylinder and having a circumferential ledge member (47,48) about each respective end portion and having axially-spaced end portions each defining a respective cylindrical opening of predetermined dimension;

a pair of axially-spaced journal members (11, 12) each having an outer cylindrical portion received within a respective one of said cylindrical openings and affixed to the respective tubular end portion;

a second tubular cylinder (16) having an inner diameter (69) greater than the outer diameter (70) of said first tubular cylinder and being mounted thereon and affixed thereto, said second tubular cylinder having a circumferentially expandable portion axially extending (46) between said journal members;

actuatable pressure means (18) having a circumferential pressure chamber (17) axially and substantially co-extending with said expandable portion of said second tubular cylinder, said pressure chamber being generally defined between circumferentially spaced wall portions (45) of said first and second tubular cylinders.

7. A printing system, comprising:

an expandable printing mandrel having a first tubular cylinder (13) having axially-spaced end portions each defining a respective cylindrical opening of predetermined dimension, a pair of axially-spaced journal members (11, 12) each having an outer cylindrical portion received within a respective one of said cylindrical openings and affixed to the respective tubular end portion, a second tubular cylinder (16) having an inner diameter (69) greater than the outer diameter (70) of said first tubular cylinder and being mounted thereon and affixed thereto, said second tubular cylinder having a circumferentially expandable portion axially extending (46) between said journal members, actuatable pressure means (18) having a circumferential pressure chamber (17) axially and substantially co-extending with said expandable portion of said second tubular cylinder, said pressure chamber being generally defined between circumferentially spaced wall portions (45) of said first and second tubular cylinders; and a plurality of image printing cylinder means (61,62) each having substantially the same inner diameter measurement (67) and predetermined different outer diameter measurement (65,66) and each selectively being slidably mountable on said second tubular cylinder for providing a plurality of different sized image printing cylinders each mountable on the expandable printing mandrel.

* * * * *